United States Patent [19]

Maldonado

[11] Patent Number: 4,788,532

[45] Date of Patent: Nov. 29, 1988

[54] COMBINED BELT AND ALARM

[76] Inventor: Robert Maldonado, 12325 Lavina La., Garden Grove, Calif. 92641

[21] Appl. No.: 60,173

[22] Filed: Jun. 10, 1987

[51] Int. Cl.[4] ..... G08B 15/00

[52] U.S. Cl. ..... 340/574; 200/43.04; 200/43.07

[58] Field of Search ..... 340/574; 200/16 R, 16 C, 200/16 D, 43.07, 43.04

[56] References Cited

U.S. PATENT DOCUMENTS 1,117,646 11/1914 Durbin et al. ..... 200/43.07

4,157,540 6/1979 Oros ..... 340/574

4,392,126 7/1983 Loyola ..... 340/668

4,404,549 9/1983 Berg ..... 340/574

*Primary Examiner*—Glen R. Swann, III

*Attorney, Agent, or Firm*—Leon Gilden

[57] ABSTRACT

A conventional belt for supporting articles of clothing includes a battery powered audible alarm. A conventional spring biased on-and-off push button switch is used to selectively turn the alarm on and off. A key system is also used to prevent the alarm from being silenced once activated.

2 Claims, 2 Drawing Sheets

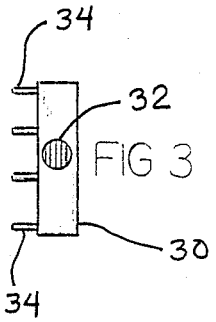
FIG 3
FIG 4
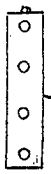
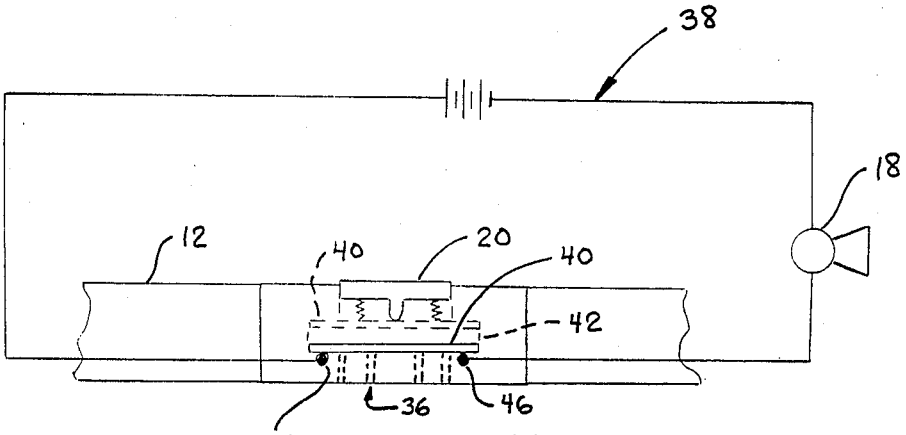
FIG 5

COMBINED BELT AND ALARM

BACKGROUND OF THE INVENTION

Field of the Invention

The present invention relates to personal alarms, and more particularly pertains to a new and improved personal alarm system which is carried by a clothing supporting belt.

Description of the Prior Art

The use of personally carried manually operable audible alarms is well known in the prior art. Additionally, at least one audible alarm system has been developed wherein the same is combined with a belt. More specifically, reference is made to U.S. Pat. No. 4,392,126, which issued to L. Loyola on July 5, 1983, wherein there is disclosed a combination belt buckle and alarm. Through the manual compression of the buckle assembly, electrical contacts are closed which operate a battery-powered alarm contained within the buckle.

While being functional for its intended purpose, it can be appreciated that the combined buckle and audible alarm of Loyola possesses the disadvantage of being somewhat difficult to activate inasmuch as a proper grasping and compression of the associated belt buckle must be undertaken or the alarm will not sound. Further, there could arise situations where an attacker would be aware of this particular type of alarm system, and the attacker could easily deactivate the system by a proper reverse movement of the belt buckle. As such, only a brief sounding of the alarm might occur which could greatly jeopardize the security of the person wearing the alarm. This is particularly true in the case of small children wherein they could be quickly overpowered by an attacker and the brief sounding of an audible alarm would most likely not attract any attention.

Accordingly, there would appear to be a need for a new and improved clothing-worn personal alarm system wherein the same could not be easily deactivated once an alarm has been sounded. In this respect, the present invention substantially addresses this need.

SUMMARY OF THE INVENTION

In view of the foregoing disadvantages inherent in the known types of personally carried manually operable portable alarms now present in the prior art, the present invention provides an improved portable alarm wherein the same is carried in a belt and cannot be deactivated without the use of a special key separate therefrom. As such, the general purpose of the present invention, which will be described subsequently in greater detail, is to provide a new and improved portable personal alarm which has all the advantages of the prior art portable personal alarms and none of the disadvantages.

To attain this, the present invention comprises an audible alarm, such as a siren or the like, which is mounted within an interior chamber of a clothing supporting belt. The siren is battery powered and may be selectively activated by a push button switch mounted within the material of the belt. In a preferred embodiment of the invention, the spring-biased push button switch will effect the movement of a slide switch into a circuit closing condition, thus to activate the alarm. The slide switch will be sealingly contained within the housing, and the alarm can only be deactivated by the insertion of an appropriately designed key which can be inserted into an opening in the housing to thus move the slide switch into an open circuit condition. As such, once the alarm is activated, it cannot be deactivated by anyone other than a person who has the proper deactivation key.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable personal alarm system which has all the advantages of the prior art portable personal alarm systems and none of the disadvantages.

It is another object of the present invention to provide a new and improved portable personal alarm system which may be easily and efficiently manufactured and marketed.

It is a further object of the present invention to provide a new and improved portable personal alarm system which is of a durable and reliable construction.

An even further object of the present invention is to provide a new and improved portable personal alarm system which is susceptible of a low cost of manufacture with regard to both materials and labor, and which accordingly is then susceptible of low prices of sale to the consuming public, thereby making such portable personal alarm systems economically available to the buying public.

Still yet another object of the present invention is to provide a new and improved portable personal alarm system which provides in the apparatuses and methods of the prior art some of the advantages thereof, while simultaneously overcoming some of the disadvantgaes normally associated therewith.

Still another object of the present invention is to provide a new and improved portable personal alarm which is particularly designed to be worn with a belt.

Yet another object of the present invention is to provide a new and improved portable personal alarm system when activated cannot be deactivated without the use of a specially designed key.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a side elevation view of the alarm deactivation key forming a part of the present invention.

FIG. 4 is a front elevation view of the key.

FIG. 5 is a schematic illustration of the switch apparatus used to operate the present invention.

DESCRIPTION OF THE PREFERRED EMBODIMENT

Figure 2:
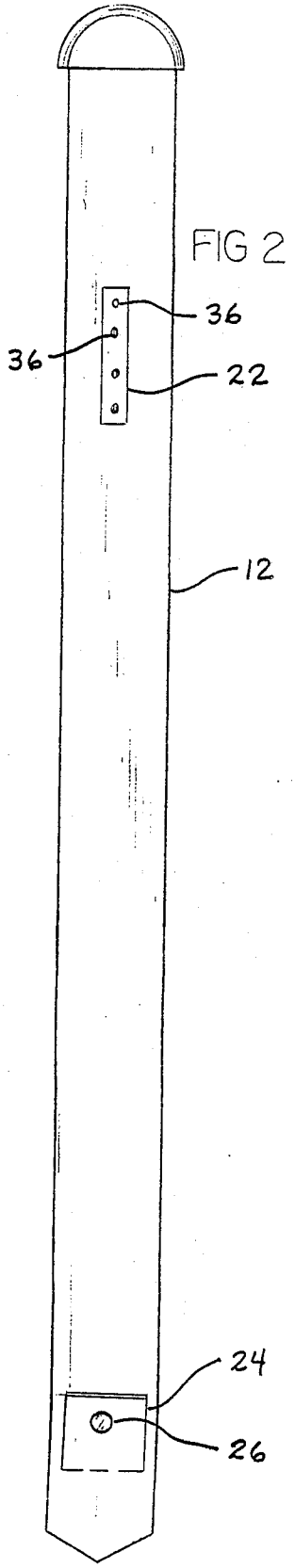
FIG. 2 is a bottom plan view of the belt.
Figure 1:
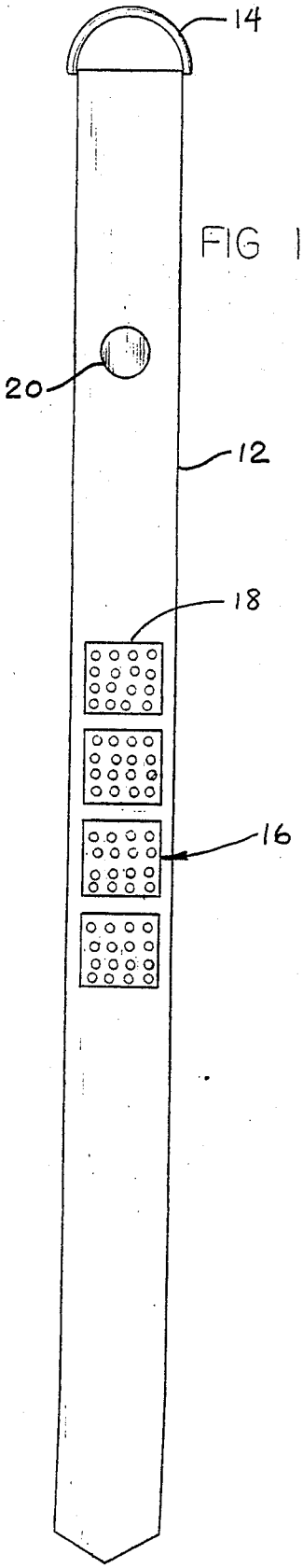
FIG. 1 is a top plan view of the combined belt and alarm system comprising the present invention.

With reference now to the drawings, and in particular to FIGS. 1 and 2 thereof, a new and improved combined alarm and belt system embodying the principles and concepts of the present invention and generally designated by the reference numeral will be described.

More specifically, it will be noted that in the preferred embodiment of the invention, the flexible clothing supporting belt 12 may be provided with a conventional buckle 14. The belt 12 includes an interior sealed chamber portion along its entire length with this interior chamber serving to house the various components of a manually operable audible alarm system generally designated by the reference numeral 16. The alarm system 16 includes a plurality of sirens 18, and also one or more push button switches 20 which facilitate a manual actuation of the alarm system 16.

With particular reference to FIG. 2 of the drawings, it will be noted that the reverse side of the belt 12 may include alarm deactivation key slots 22 positioned oppositely the push button switches 20, and may also include a zippered compartment 24 for holding a replaceable battery pack. A low power indicating light emitting diode 26 of a conventional design may also be utilized in the combination of the invention 10 and may be attached to an exercise visible surface of the compartment 24.

FIGS. 3 and 4 of the drawings illustrate a deactivation key 30 which is illustrative of many different designs of such keys which could be utilized. The deactivation key 30 is illustrated as being of a substantially rectangular design having finger grips 32 on opposed sides thereof and a plurality of outwardly extending spaced apart prongs 34. The prongs 34 are designed to be received by a plurality of apertures 36 positioned in the alarm deactivation units 22. In this regard, an insertion of a deactivation key 30 into the alarm deactivation unit 22 will effect an interruption of the power supply circuit to the sirens 18, thereby to silence the alarm.

To understand the manner of usage and operation of the present invention, reference is made to FIG. 5 of the drawings wherein it can be understood that a wearer of the belt 12 can selectively close the electrical circuit 38 by a manual depression of the push button switch 20. The spring-biased switch 20 will cause the electrically conductive slider switch 40 to slide downwardly within its housing 42 to thus effect the establishment of electrical communication between the conductor ends 44, 46. The alarm 18 will then be activated, and it is apparent from reference to FIG. 5 that a further manual depressing of the push button switch 20 will not break the circuit between the conductor ends 44, 46.

To deactivate the alarm, the wearer must utilize the key 30 wherein the prongs 34 are inserted into the apertures 36. As illustrated, the insertion of the prongs 34 into the apertures 36 will effect the upward movement of the slider switch 40 within its housing 42, and this upward movement will open the circuit between the conductor ends 44, 46 to thus silence the alarm 18.

As can be appreciated, the design of the present invention 10 is such that once the alarm 18 has been activated, it cannot easily be silenced. This could be particularly useful in the case of a small child who is being abducted or attacked—especially if the attacker knew some quick and simple way to silence the alarm 18. Of course, the deactivation key 30 could be carried by an adult separate from the child, or a wearer of the belt 12 could keep the key hidden on his person to further prevent an easy deactivation of the alarm 18 by an attacker.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A personal portable alarm system comprising:

belt means designed to be worn around a torso portion of a wearer;

audible alarm means comprising a siren fixedly secured to said belt means;

a battery pack for supplying operating power to said siren;

said battery pack being retained within a holding pocket formed in said belt means;

switch means for facilitating a selective manual actuation of said audible alarm means;

said switch means comprising a push button switch positioned to operate a slide means associated therewith, said slide means serving to close an electrical circuit connecting said battery pack to said audible alarm means, and key means operative to move said slide means into an open circuit condition; and wherein said key means is insertible into a housing holding said slide means, said key means having a plurality of prongs which abut against said slide means during an insertion of said key means into said housing, said prongs moving said slide means into said open circuit condition when inserted into said housing.

2. The personal portable alarm system as described in claim 1, and further including a low power indicating light associated with said battery pack.

* * * * *